US010074930B2

(12) United States Patent
Zhu et al.

(10) Patent No.: US 10,074,930 B2
(45) Date of Patent: Sep. 11, 2018

(54) ELECTRICAL CONNECTOR HAVING EXCELLENT WATERPROOF PROPERTY

(71) Applicant: FOXCONN INTERCONNECT TECHNOLOGY LIMITED, Grand Cayman (KY)

(72) Inventors: Zhi-Hui Zhu, Kunshan (CN); Da-Wei Zhang, Kunshan (CN); Shu-Jian Wang, Kunshan (CN); Yen-Chih Chang, New Taipei (TW); Ming-Guang Bai, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/588,716

(22) Filed: May 8, 2017

(65) Prior Publication Data

US 2017/0324186 A1 Nov. 9, 2017

(30) Foreign Application Priority Data

May 6, 2016 (CN) ..... 2016 2 0403429 U

(51) Int. Cl.
*H01R 13/6598* (2011.01)
*H01R 13/52* (2006.01)
*H01R 13/6594* (2011.01)

(52) U.S. Cl.
CPC ..... *H01R 13/521* (2013.01); *H01R 13/5202* (2013.01); *H01R 13/5216* (2013.01); *H01R 13/6594* (2013.01); *H01R 13/6598* (2013.01)

(58) Field of Classification Search
CPC ..... H01R 2107/00; H01R 12/724; H01R 13/6582; H01R 24/60; H01R 13/6585; H01R 13/6581; H01R 13/6594; H01R 13/6275; H01R 13/5219; H01R 13/658; H01R 13/65802; H01R 13/622; H01R 13/642; H01R 13/665
See application file for complete search history.

(56) References Cited

U.S. PATENT DOCUMENTS 6,514,102 B1 * 2/2003 Murakami ..... H01R 13/5208 439/587
2004/0018772 A1 * 1/2004 Zhang ..... H01R 12/716 439/607.01

(Continued)

FOREIGN PATENT DOCUMENTS

TW M447009 2/2013

*Primary Examiner* — Truc Nguyen
(74) *Attorney, Agent, or Firm* — Wei Te Chung; Ming Chieh Chang

(57) ABSTRACT

An electrical connector includes a terminal module, a shielding shell surrounding the terminal module to form a mating cavity opening forwardly and a waterproof member disposed at a rear side of the mating cavity. The terminal module has an insulative housing and a plurality of conductive terminals retained in the insulative housing. The insulative housing has a base portion and a mating portion extending forwardly from the base portion. The shielding shell has a metallic shell and a waterproof shell formed integrally with the metallic shell by insert molding. The mating portion extends into the mating cavity. The waterproof shell defines an opening to which the waterproof member is exposed.

20 Claims, 9 Drawing Sheets

(56) References Cited

U.S. PATENT DOCUMENTS

| | | | | |
|---|---|---|---|---|
| 2008/0176425 | A1* | 7/2008 | Sakakura | H01R 13/5216 439/78 |
| 2009/0233484 | A1* | 9/2009 | Wu | H01R 13/6582 439/607.05 |
| 2012/0108095 | A1* | 5/2012 | Liu | H01R 13/5219 439/271 |
| 2012/0329337 | A1* | 12/2012 | Kataoka | H01R 13/405 439/692 |
| 2013/0183844 | A1* | 7/2013 | Wang | H01R 24/68 439/271 |
| 2013/0183867 | A1* | 7/2013 | Wu | H01R 24/58 439/668 |
| 2015/0244101 | A1* | 8/2015 | Chien | H01R 13/5202 439/271 |
| 2015/0364864 | A1* | 12/2015 | Wang | H01R 13/629 439/607.01 |
| 2016/0093974 | A1* | 3/2016 | Lai | H01R 13/5202 439/736 |
| 2016/0149337 | A1* | 5/2016 | Ozaki | H01R 13/5219 439/529 |

* cited by examiner

ELECTRICAL CONNECTOR HAVING EXCELLENT WATERPROOF PROPERTY

BACKGROUND OF THE INVENTION

1. Field of the Invention

The present invention generally relates to an electrical connector, particularly to an electrical connector with excellent waterproof property.

2. Description of Related Art

With the growing demand to the electronic device's waterproof property, many companies pay much attention to design waterproof electrical connectors. Fortunately, we develop a kind of waterproof connector. The waterproof connector has a terminal module and a metallic shell surrounding therearound. The metallic shell surrounds the terminal module to form a mating cavity opening forwardly. The waterproof connector has a waterproof member disposed at a rear side of the mating cavity to prevent the external liquid material rearwardly flowing into the electronic device from the mating cavity. The metallic shell defines an opening. The waterproof material is filled inside from the opening to form the waterproof member. As to the waterproof connector, the combination between the waterproof material and the metallic shell is poor, the thickness of the metallic shell is thin, and the contacting area between the waterproof member and the metallic shell is small. Therefore it is not easy to assure the sealing effect around the opening.

Therefore, an electrical connector having excellent waterproof property is desired hereinafter.

SUMMARY OF THE INVENTION

Accordingly, an object of the present invention is to provide an electrical connector with excellent waterproof property.

In order to achieve the object set forth, an electrical connector comprises a terminal module, a shielding shell surrounding the terminal module to form a mating cavity opening forwardly and a waterproof member disposed at a rear side of the mating cavity. The terminal module has an insulative housing and a plurality of conductive terminals retained therein. The insulative housing has a base portion and a mating portion extending forwardly therefrom. The shielding shell has a metallic shell and a waterproof shell insert molded on the metallic shell. The mating portion extends into the mating cavity. The waterproof shell defines an opening to which the waterproof member is exposed.

Other objects, advantages and novel features of the invention will become more apparent from the following detailed description when taken in conjunction with the accompanying drawings.

BRIEF DESCRIPTION OF THE DRAWINGS

FIG. 3 is a perspective view of the electrical connector shown in FIG. 1, wherein waterproof material is not filled in;

DETAILED DESCRIPTION OF THE INVENTION

Reference will now be made in detail to the preferred embodiment of the present invention.

Figure 1:
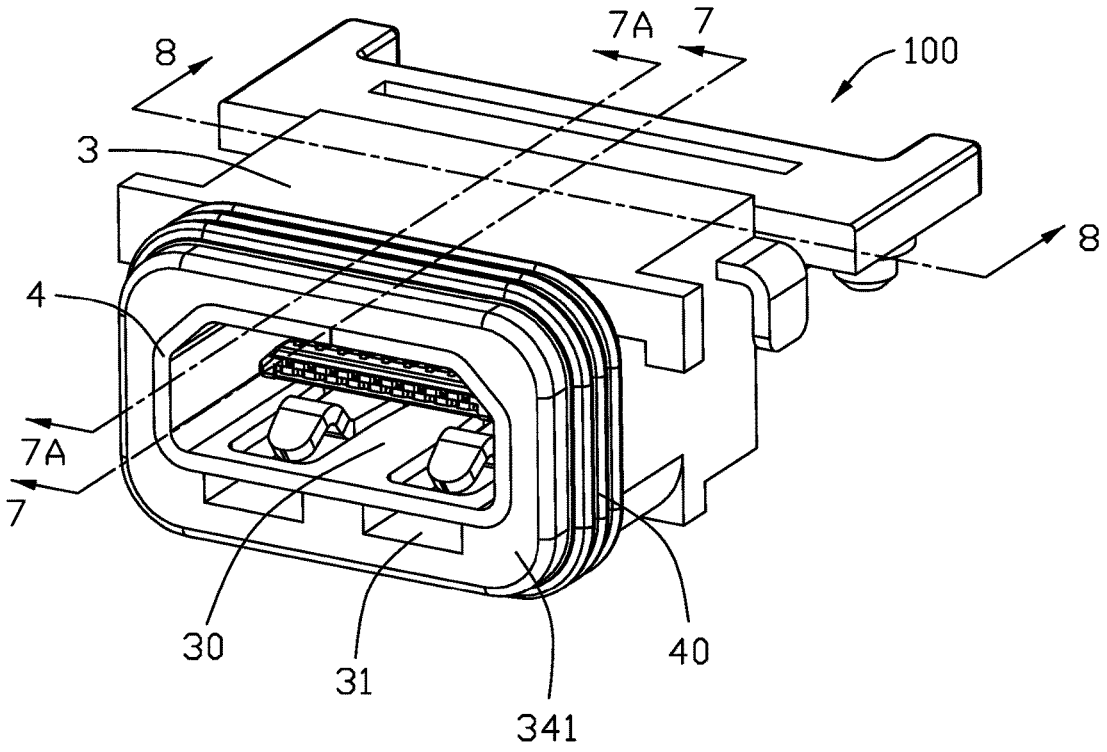
FIG. 1 is a perspective view of an electrical connector of the present invention.
Figure 2:
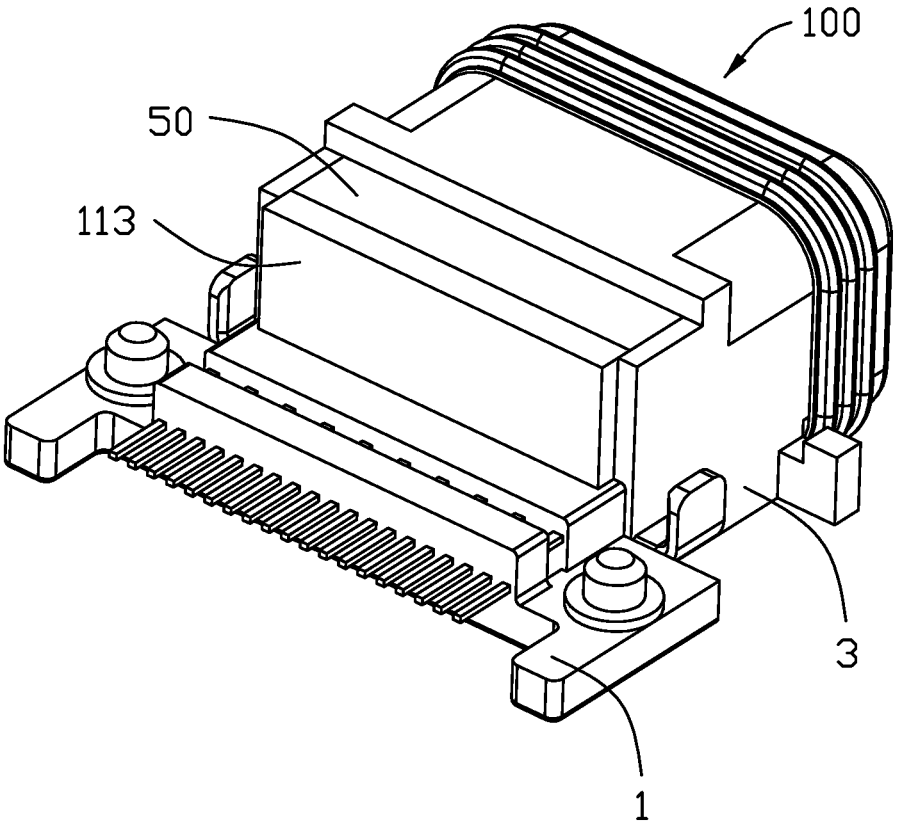
FIG. 2 is another perspective view of the electrical connector shown in FIG. 1.
Figure 3:
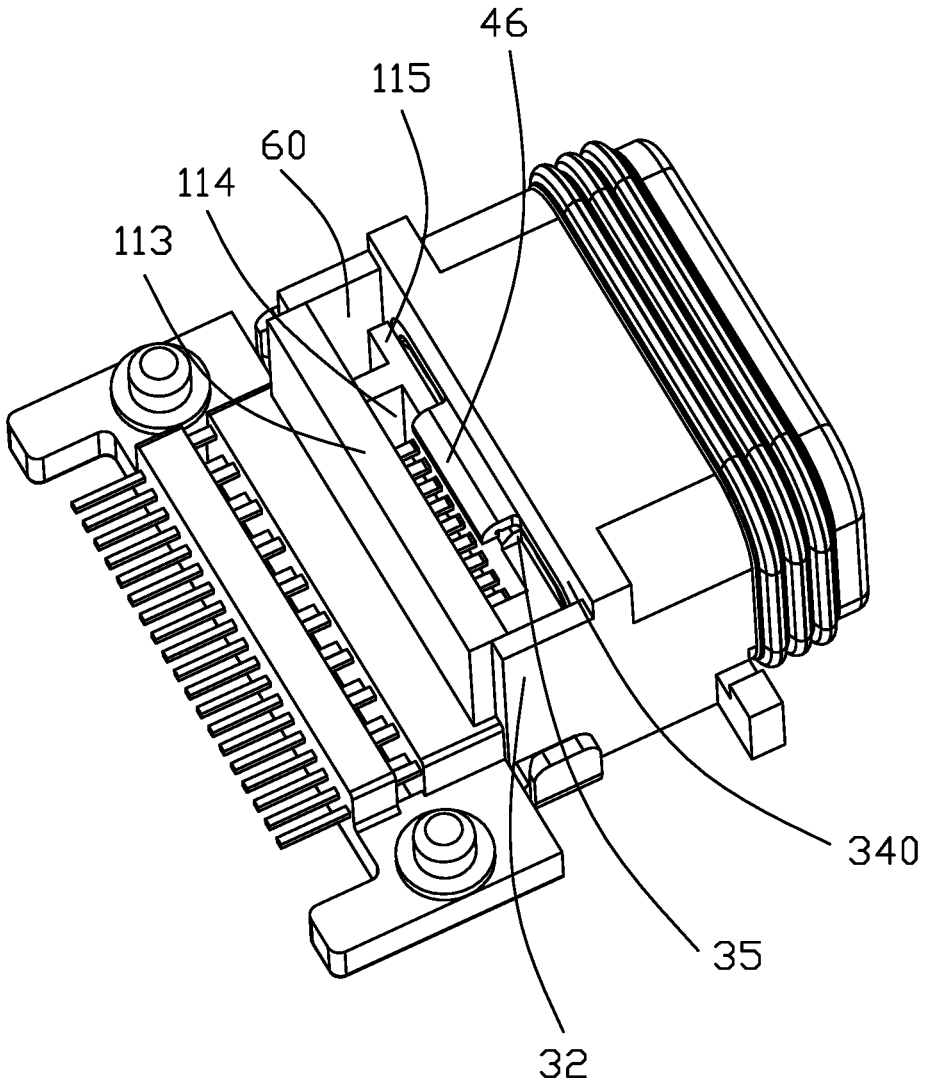

Referring to FIG. 1 and FIG. 2, the present invention provides an electrical connector 100 to be used in an electronic device (not shown). The electrical connector 100 has a terminal module 10 and a shielding shell 20 surrounding therearound. The shielding shell 20 surrounds the terminal module 10 to form a mating cavity 30 opening forwardly. The electrical connector 100 has a waterproof member 50 disposed at a rear side of the mating cavity 30. The waterproof member 50 is exposed to an external.

Figure 4:
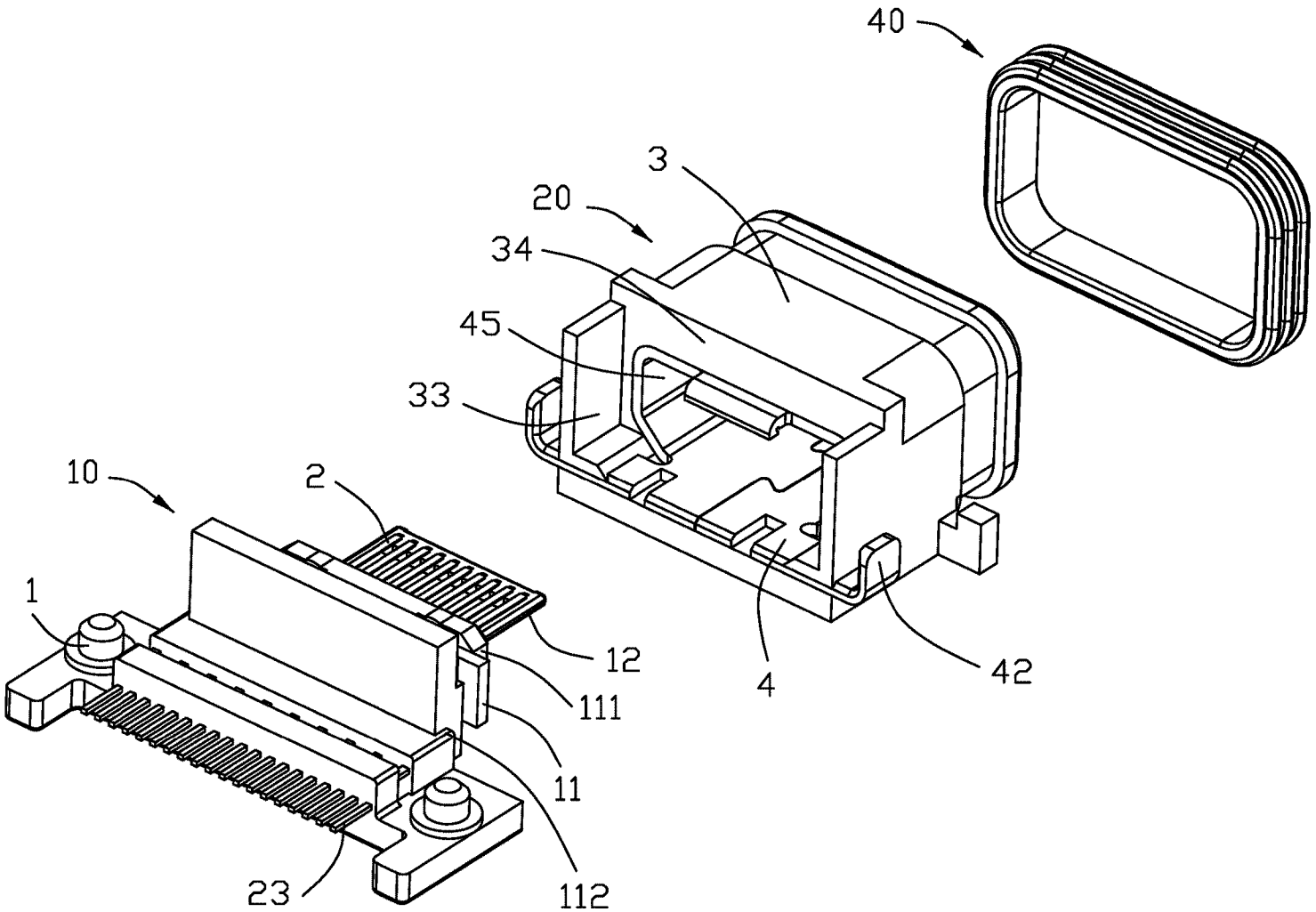
FIG. 4 is a part exploded perspective view of the electrical connector shown in FIG. 3.
Figure 7:
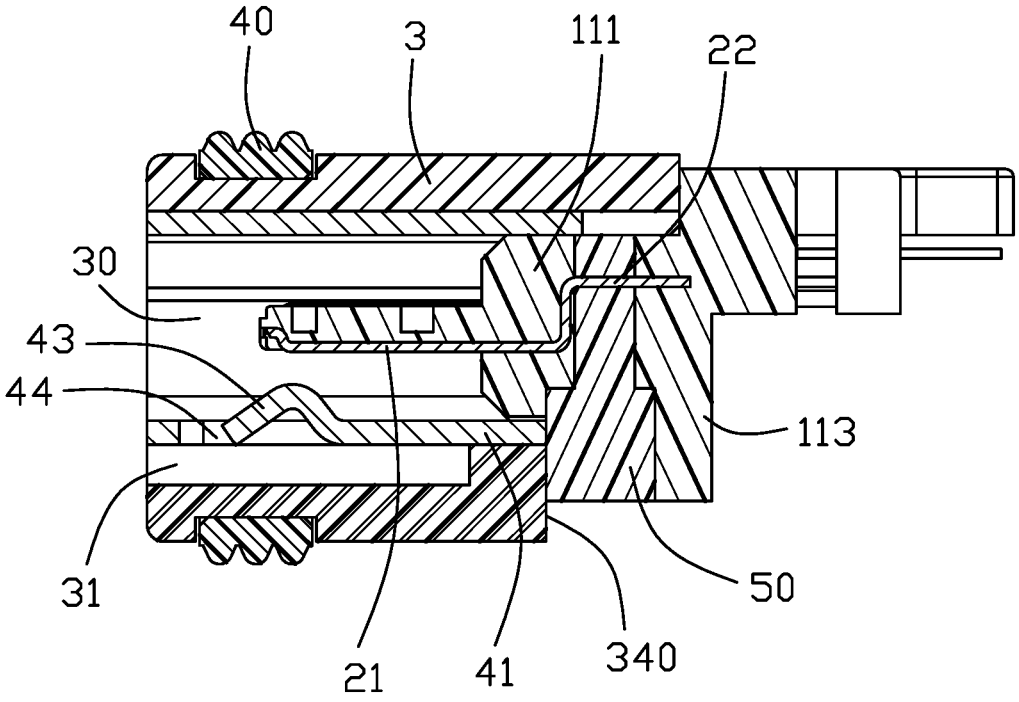
FIG. 7 is a cross-sectional view of the electrical connector shown in FIG. 1 along line 7-7.

Referring to FIG. 4 and FIG. 7, the terminal module 10 has an insulative housing 1 and a plurality of conductive terminals 2 retained in the insulative housing 1. The insulative housing 1 has a base portion 11 and a mating portion 12 extending forwardly into the mating cavity 30 from the base portion 11. The base portion 11 has a front base portion 111 and a rear base portion 112. The rear base portion 112 is thicker than the front base portion 111. The conductive terminals 2 has connecting portions 22 retained in the base portion 11, contacting portions 21 extending forwardly from the connecting portions 22 and exposed to the mating portion 12 and mounting legs 23 extending rearwardly beyond the insulative housing.

Figure 5:
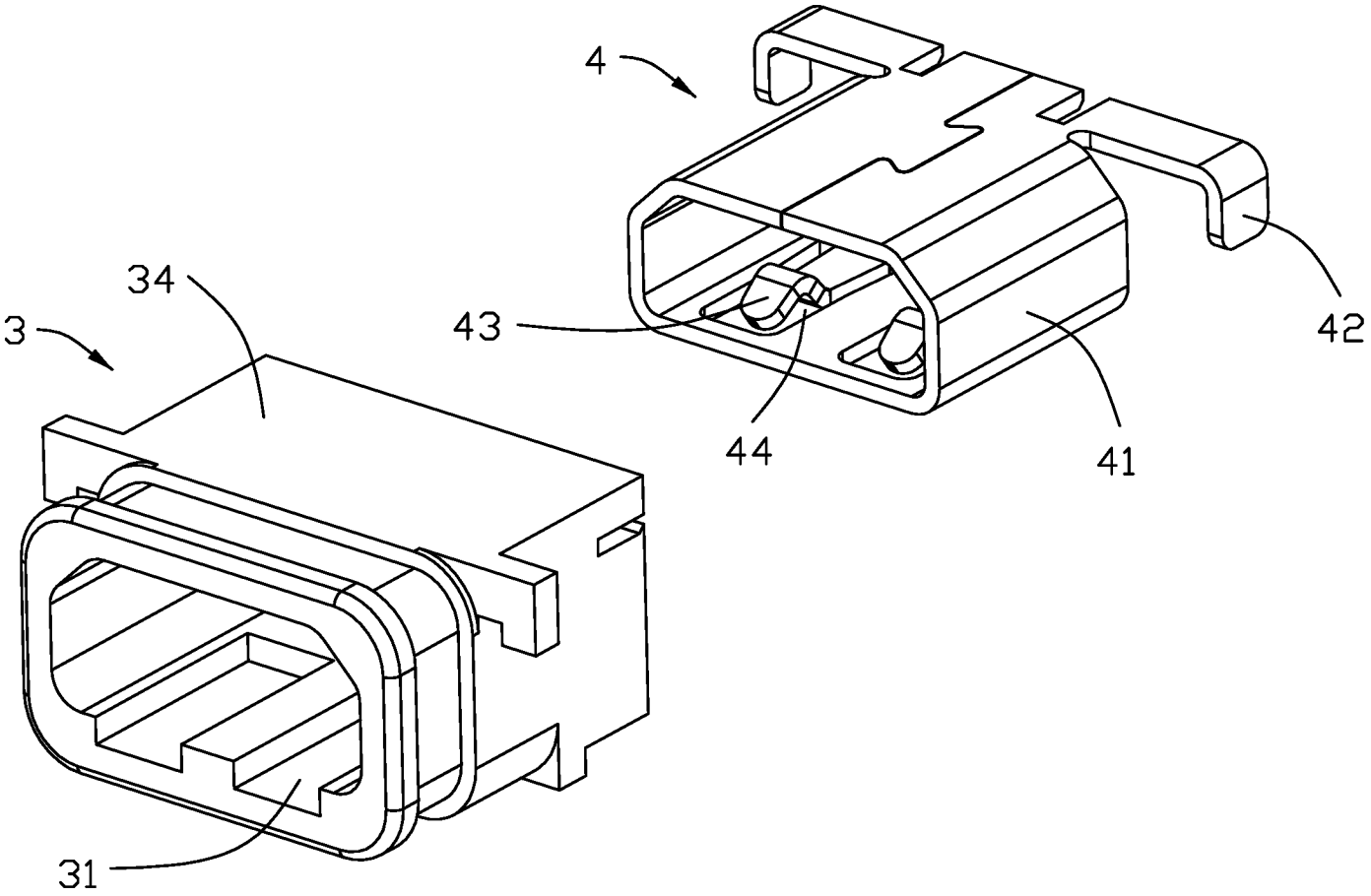
FIG. 5 is an exploded perspective view of the shielding shell shown in FIG. 4.
Figure 6:
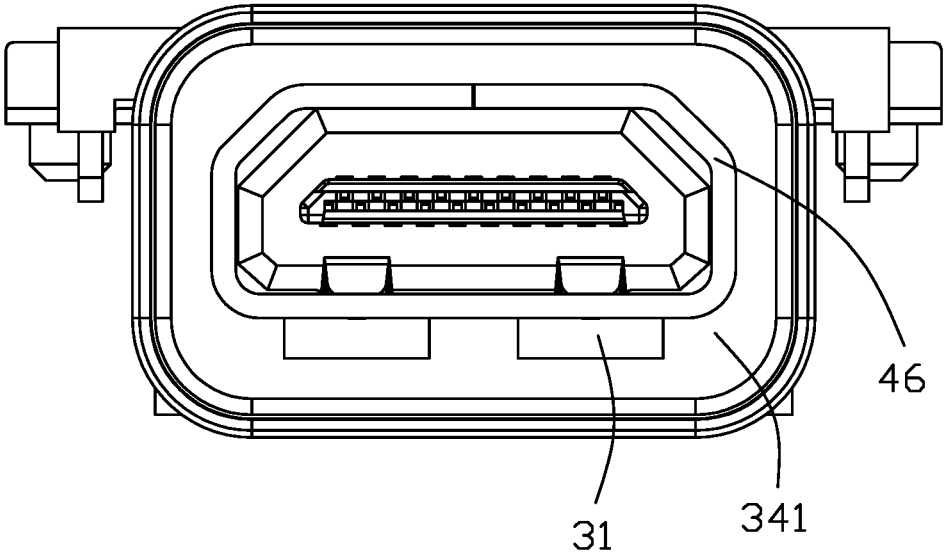
FIG. 6 is a front elevational view of the electrical connector shown in FIG. 1.

Referring to FIG. 4 and FIG. 5, the shielding shell 20 has a metallic shell 4 and a waterproof shell 3 embedded on the metallic shell 20. That is to say, the metallic shell 4 and the waterproof shell 3 are formed integrally by insert molding. The metallic shell 4 has a surrounding portion 41 and two retaining legs 42 extending rearwardly and outwardly beyond the waterproof shell 3 from the surrounding portion 41. The surrounding portion 41 surrounds the terminal module 10 to form the mating cavity 30. The surrounding portion 41 defines two resilient pressing portions 43 extending inwardly into the mating cavity 30 and two corresponding opening slots 44. The surrounding portion 41 has a first rear opening 45 opening rearwardly and opposite to the mating cavity 30. The front base portion 111 is received in the surrounding portion 41. The rear base portion 112 is disposed behind the first rear opening 45. The rear base portion 112 defines an accommodating room 114 in which the waterproof member 50 is injected. The insulative housing 1 has a stopping portion 115 covering the first rear opening 45. The stopping portion 115 is used to prevent the waterproof material flowing forwardly from a gap formed between the front base portion and the surrounding portion. The retaining leg 42 extends rearwardly and outwardly from the surrounding portion 41, therefore the surrounding portion 41 does not need to define a mounting leg and a corresponding opening which is benefit for simplifying the structure of the electrical connector, the process of forming the electrical connector and the molding die used for forming the electrical connector. The waterproof property is greatly improved.

Referring to FIG. 2 to FIG. 4 and FIG. 7, the waterproof shell 3 is made of insulative plastic material or elastic material. If the waterproof shell 3 is made of insulative plastic material, a waterproof ring 40 is disposed around an outer surface of the waterproof shell 3 to interfere with the electronic device. If the waterproof shell 3 is made of elastic material, the waterproof shell 3 unitarily forms an interfering portion protruding outwardly to replace the waterproof ring 40. The waterproof shell 3 has an outer side wall 34 surrounding the surrounding portion 41 and an extending wall 32 extending rearwardly from the surrounding portion 41. A front side of the outer side wall 34 is aligned with a front side of the surrounding portion 41. The extending wall 32 surrounds to form a second rear opening 33 opening rearwardly. The insulative housing 1 defines a stopping wall 113 blocking the second rear opening 33. The waterproof shell 3 cooperates with the stopping wall 113 to commonly define an opening 60 downwardly communicating with an exterior in a vertical direction. The extending wall 32 and the stopping wall 113 are disposed around the opening 60. The waterproof material is disposed into an internal space of the electrical connector 100 from the opening 60 to form the waterproof member 50. The extending wall 32 and the stopping wall 113 are disposed around the waterproof member 50. The waterproof member 50 contacts with the stopping wall 113 to enhance the retaining force between the waterproof member 50 and the terminal module 10 to be benefit for preventing the terminal module 10 and the shielding shell 20 from separating during usage. In the present preferred embodiment, the waterproof member 50 is attached to a rear side face 340 of the outer side wall 34 around the opening 60, therefore the waterproof member 50 and the waterproof shell 3 are tightly combined with each other to seal the first rear opening 45 of the surrounding portion 41.

Figure 8:
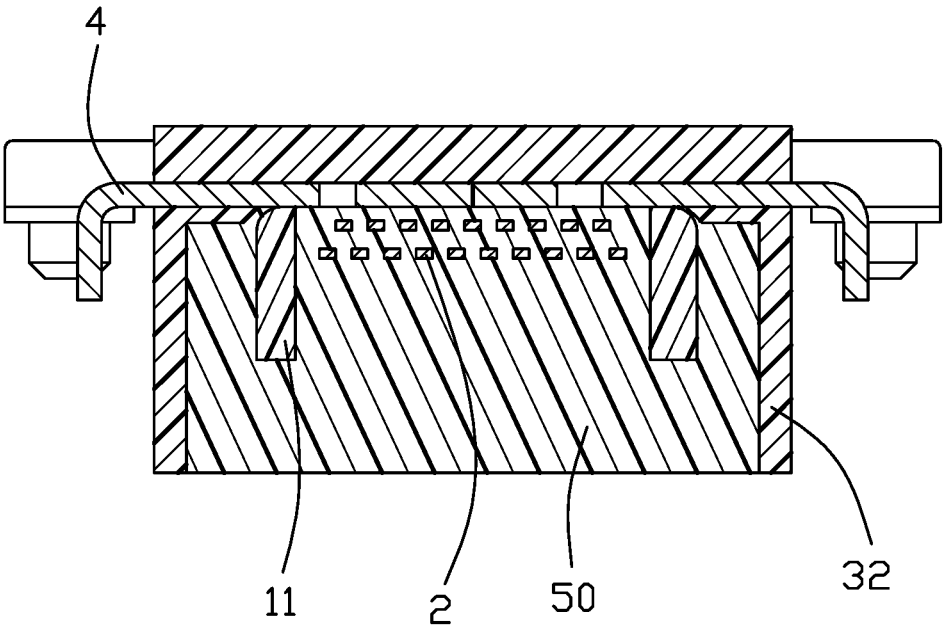
FIG. 8 is a cross-sectional view of the electrical connector shown in FIG. 1 along line 8-8.

Referring to FIG. 7 and FIG. 8, the waterproof member 50 is formed in a rear side of the surrounding portion 41 and between the base portion 11 and the shielding shell 20. The waterproof member 50 is disposed around the conductive terminals 2. The waterproof member 50 is disposed between the base portion 11 and the waterproof shell 3. In some other embodiments, the waterproof member 50 may be disposed between the base portion 11 and the metallic shell 4. In the present preferred embodiment, the waterproof member 50 is exposed to the opening 60 and exposed to an external from the opening 60. Certainly, in some other embodiments, the waterproof member 50 may be exposed to the opening 60 but not exposed to an external (such as the opening hole and the internal space are completely staggered). It is benefit for preventing an external member from damaging the waterproof member 50 when the opening 60 and the internal space are staggered. When the waterproof member 50 is disposed between the base portion 11 and the surrounding portion 41, the opening 60 and the surrounding portion 41 may be staggerly disposed so that there is no need to dispose an opening in the surrounding portion 41.

Figure 7A:
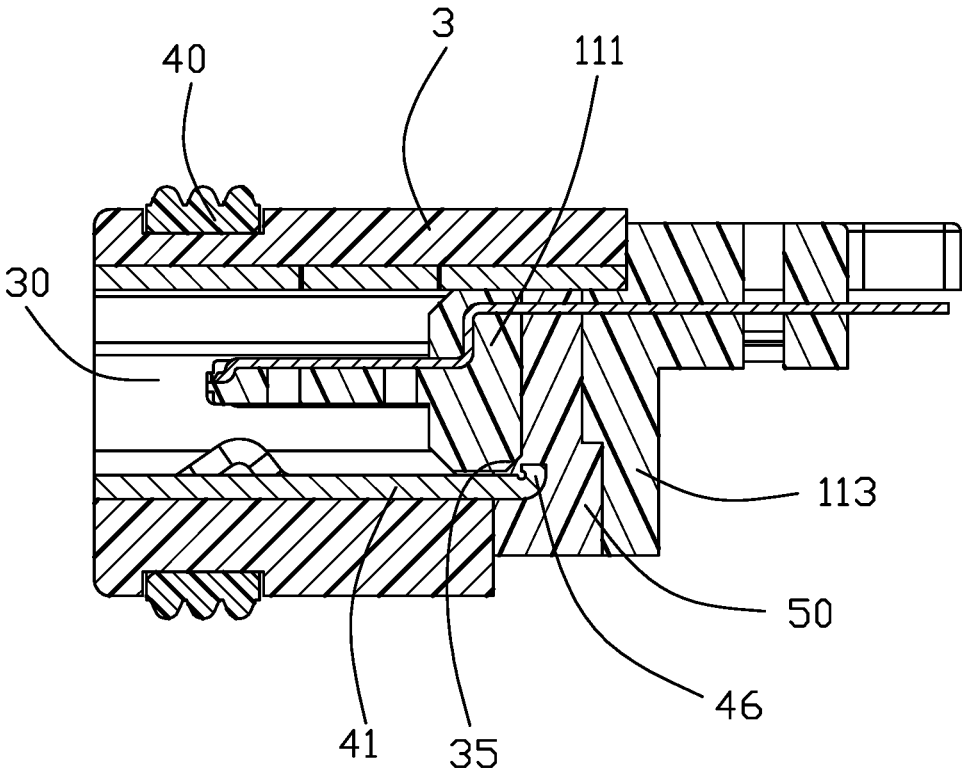
FIG. 7(A) is another cross-sectional view of the electrical connector showing FIG. 1 along line 7(A)-7(A)

Referring to FIGS. 4 and 7(A), in the present preferred embodiment, the shielding shell 20 is initially formed, and then the terminal module 10 is assembled into the shielding shell 20 along a back-to-front direction. Certainly, in some other embodiments, the terminal module 10 may be initially assembled into the metallic shell 4, and then forming the waterproof shell 3. In some conditions, the way to form the shielding shell 20 in the present preferred embodiment is more easy and convenient. The insulative housing 1 defines a first stopping portion 35. The metallic shell 4 has a second stopping portion 46 bending to cooperate with the first stopping portion 35 to restrict the terminal module 10. The second stopping portion 46 is located behind the first stopping portion 35. The first stopping portion 35 and the second stopping portion 46 are both embedded in the waterproof member 50.

Referring to FIG. 1, FIG. 5 to FIG. 7, the waterproof shell 3 has two slots 31 respectively disposed at outer sides of the two opening slots 44. In the present preferred embodiment, the two slots 31 are two die holes going through a front face 341 of the waterproof shell 3. The die holes are formed after the molding die is exited. When forming the waterproof shell 3, the molding die is disposed to cover the opening slot 44 to prevent the waterproof material from flowing into the opening slot 44. When the resilient pressing portion 43 is pressed by an external pressure, the resilient pressing portion 43 may move into the die hole 31.

In the present preferred embodiment, the waterproof shell 3 has the opening 60 in front of the stopping wall 113 and surrounded by the extending wall 32. The waterproof member 50 combines with the rear side face 340 around the opening 60. The aforementioned structure is benefit for improving the waterproof property of the electrical connector 100.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

a terminal module having an insulative housing and a plurality of conductive terminals integrally retained in the insulative housing, the insulative housing having a base portion and a mating portion extending forwardly from the base portion;

a shielding shell surrounding the terminal module to form a mating cavity opening forwardly, the shielding shell having a metallic shell and an insulative waterproof shell formed integrally with the metallic shell by insert molding, the mating portion extending into the mating cavity; and an insulative waterproof member disposed behind the mating cavity;

wherein the waterproof shell defines an opening, and the waterproof member is exposed to the opening;

wherein the waterproof shell has an extending wall extending rearwardly, the extending wall forms a rear opening opening rearwardly, the insulative housing has unitarily a stopping wall blocking the rear opening, the waterproof member is disposed in an internal space surrounded by the extending wall and the stopping wall, and the extending wall and the stopping wall are disposed around the opening; wherein the terminals extend rearwardly through the stopping wall.

2. The electrical connector as claimed in claim 1, wherein the waterproof member is made of waterproof material, and the waterproof material enters an internal space of the electrical connector from the opening to form the waterproof member.

3. The electrical connector as claimed in claim 1, wherein the waterproof member is disposed between the base portion and the shielding shell.

4. The electrical connector as claimed in claim 1, wherein the waterproof member is disposed around the conductive terminals.

5. The electrical connector as claimed in claim 1, wherein the metallic shell has a surrounding portion surrounding the terminal module to form the mating cavity, the waterproof shell has an outer side wall surrounding the surrounding portion, the extending wall extends rearwardly beyond the surrounding portion, the surrounding portion has another rear opening, and the waterproof member is located behind the surrounding portion and attached to a rear side face of the outer side wall around the opening.

6. The electrical connector as claimed in claim 1, wherein the metallic shell has a surrounding portion surrounding the terminal module to form the mating cavity, the surrounding portion has another rear opening, and the stopping wall of the insulative housing defines a covers said another rear opening.

7. The electrical connector as claimed in claim 5, wherein the terminal module is assembled into the shielding shell from said another rear opening along a back-to-front direction, the base portion has a front base portion received in the surrounding portion and a rear base portion disposed at a rear side of said another rear opening, and the rear base portion defines an accommodating room in which the waterproof member is disposed.

8. The electrical connector as claimed in claim 3, wherein the metallic shell has a surrounding portion surrounding the terminal module to form the mating cavity, the waterproof shell is disposed between the base portion and the surrounding portion, and the opening and the surrounding portion are disposed staggerly.

9. The electrical connector as claimed in claim 1, wherein the metallic shell has a resilient pressing portion extending inwardly into the mating cavity and a corresponding opening slot, and the waterproof shell has an slot disposed at an outer side of the opening slot and going through thereof, and said slot receives said resilient pressing portion therein only when a plug is inserted into the mating cavity to outwardly deflect said resilient pressing portion to move said resilient pressing portion into said slot.

10. The electrical connector as claimed in claim 1, wherein the housing includes a first stopping portion and the shielding shell includes a second stopping portion coupled with the first stopping portion and commonly embedded within the waterproof member for retaining the terminal module to the shielding shell.

11. An electrical connector, comprising:

a terminal module having an insulative housing and a plurality of conductive terminals retained in the insulative housing; and a shielding shell surrounding the terminal module to form a mating cavity forwardly communicating with an exterior along a front-to-back direction, the shielding shell having a metallic shell and an insulative waterproof shell formed integrally with the metallic shell by an insert molding process, and the metallic shell having a resilient pressing portion extending inwardly into the mating cavity and a corresponding opening slot;

wherein the waterproof shell has a slot disposed at an outer side of the resilient pressing portion and the opening slot; wherein said slot is dimensioned to receive the resilient processing portion when the resilient processing portion is outwardly deflected by a plug inserted into the mating cavity while not receiving the resilient processing portion when no plug is inserted in the mating cavity.

12. The electrical connector as claimed in claim 11, wherein the slot forwardly goes through a front face of the waterproof shell.

13. The electrical connector as claimed in claim 11, wherein the slot is originally occupied by a mold part during the insert-molding process and successively formed by removing a mold part after said insert-molding process.

14. An electrical connector comprising:

a terminal module having an insulative housing and a plurality of conductive terminals retained in the insulative housing, the insulative housing having a base portion and a mating portion extending forwardly from the base portion along a front-to-back direction, said base portion forming an internal space;

a shielding shell surrounding the terminal module to form a mating cavity opening forwardly, the shielding shell having a metallic shell and an insulative waterproof shell formed integrally with the metallic shell by an insert molding process, the mating portion extending into the mating cavity; and an insulative waterproof member received in the internal space;

wherein the waterproof shell defines an opening, and the waterproof member is exposed to the opening hole to communicate with an exterior so as to allow waterproof material to be injected into the internal space through said opening hole from the exterior to form the waterproof member; wherein a rear region of the metallic shell is embedded within the insulative waterproof shell.

15. The electrical connector as claimed in claim 14, wherein said opening faces the exterior in a vertical direction perpendicular to said front-to-back direction.

16. The electrical connector as claimed in claim 15, wherein said internal space is located behind the metallic shell while enclosed in the insulative waterproof shell.

17. The electrical connector as claimed in claim 16, wherein said base portion includes a stopping wall forwardly abutting against a rear end of the insulative waterproof shell.

18. The electrical connector as claimed in claim 14, wherein the shielding shell has a stopping portion coupled with another stopping portion formed on the housing to retain the terminal module and the shielding shell together.

19. The electrical connector as claimed in claim 18, wherein both said stopping portion and said another stopping portion are embedded within the waterproof member.

20. The electrical connector as claimed in claim 14, wherein said metallic shell further unitarily includes a pair of retaining legs extending outwardly transversely beyond two opposite sides of the insulative waterproof shell, respectively.

* * * * *